US005350891A

United States Patent [19]

Ditzig

[11] Patent Number: 5,350,891

[45] Date of Patent: Sep. 27, 1994

[54] SERVOMOTOR REMOTE CONTROL SWITCH

[75] Inventor: Albert F. Ditzig, Hoffman Estates, Ill.

[73] Assignee: Eaton Corporation, Cleveland, Ohio

[21] Appl. No.: 98,677

[22] Filed: Jul. 28, 1993

[51] Int. Cl.[5] ..... H01H 9/29; H01H 25/04

[52] U.S. Cl. ..... 200/6 A; 200/4

[58] Field of Search ..... 200/4, 5 R, 6 R, 6 A, 200/115, 11 G, 16 R, 16 A, 16 C, 16 D, 17 R, 18

[56] References Cited

U.S. PATENT DOCUMENTS

| | | | |
|---|---|---|---|
| 3,750,080 | 7/1973 | Rouvre et al. | 200/4 |
| 4,245,137 | 1/1981 | Hirai et al. | 200/4 |
| 4,816,662 | 3/1989 | Kyoden | 200/5 R |
| 5,047,596 | 9/1991 | Ebishi | 200/4 |
| 5,151,563 | 9/1992 | Tanaka | 200/6 A |

*Primary Examiner*—A. D. Pellinen

*Assistant Examiner*—Michael A. Friedhofer

*Attorney, Agent, or Firm*—Roger A. Johnston

[57] ABSTRACT

A wobble stick control switch assembly for operating remotely adjusted vehicle outside rear-view mirrors. The stick is guided through orthogonally intersecting slots to move a cylindrical holder having insert molded wiper contacts over the surface of a circuit board having pairs of stationary contacts for reversible remote servomotor control. A barrel member having a shorting bar in one end is disposed rotatably within the cylindrical holder and has a rectangular slot engaged by the end of the stick. Rotation of the stick in a clockwise and counter clockwise direction rotates the barrel to cause the shorting bar to connect separate pairs of stationary contacts on the circuit board to select as between plural remote locations to be controlled, e.g. left or right outside mirror adjustment motors. Rotation of the stick to an intermediate neutral position causes detents to lift the shorting bar from the circuit board.

5 Claims, 4 Drawing Sheets

SERVOMOTOR REMOTE CONTROL SWITCH

BACKGROUND OF THE INVENTION

The present invention relates to switches for remotely controlling servomotors such as servomotors used for changing the position of an automotive rear-view mirror, particularly where the mirrors are mounted exteriorly of the vehicle on the driver's and passenger's side. Typically, in such automotive rear-view mirror applications, a pair of servomotors is provided for each mirror for movement about a horizontal and vertical axes. In response to driver actuation of a control switch located inside the vehicle passenger compartment.

Heretofore, it has been common to provide automotive rear-view mirror adjustment control switches having a rockable or pivotably depressible bar or ring which the driver depresses at the four points of the compass, dependent upon the desired direction of movement of the mirror. A secondary switch is typically provided for selecting between the driver's side or passenger's side mirror for adjustment. Alternatively, some automotive rear-view mirror adjustment switches have employed individually depressible buttons at the four points of the compass for selecting the desired direction of mirror movement. In some arrangements, the selector switch for choosing driver's side or passenger side mirror adjustment is mounted centrally with respect to the mirror position adjustment bar or individual switches. The passenger/driver side mirror select switch has heretofore comprised a slide switch, a rocker switch, and a rotary switch. Where a wobble stick actuator has been employed for the bidirectional movement control for the mirror adjustment servomotors, some automotive applications have employed a rotary knob on the end of the wobble stick for actuating the passenger/driver side mirror select function.

Heretofore, servomotor remote control switches employing a wobble stick have required complex linkage arrangements for a plurality of individual switches within the common control switch housing, and this has resulted in prohibitive manufacturing costs for such a switch in high-volume mass production. One disadvantage, however, of a wobble stick type control is that it is extremely difficult to provide tactile feedback to the user or detent action for such a switch. Despite the user-friendly nature of the wobble stick-type switch and the marketability of such a design. Other switch configurations have been found to be more cost-effective and easier to manufacture. Thus, it has been desired to find a simplified and reliable wobble stick-type servomotor remote control switch which is low in manufacturing cost and exhibits precise operation and tactile feedback to indicate the position to the user.

SUMMARY OF THE INVENTION

The present invention provides a wobble stick-type remote control switch for operating pairs of servomotors which employs a plastic housing having the wobble stick pivotally mounted thereon and movable in two directions along a pair of orthogonal axis with the end of the wobble stick engaging a slider which is also rotated by user rotation of the wobble stick about its own axis. The slider is formed with insert molded conductive wipers which traverse a circuit board to act as the shorting bar on a plurality of pairs of spaced contacts which are connected via the circuit board to connector terminals adapted for external connection to the various servomotors to be controlled. The slider has a spring biased shorting bar in a separate cylindrical insert or barrel which is rotatable within the slider for selecting contacts for connection to either of two individual servomotor circuits. The wobble stick and its detents are assembled into an upper housing shell and the slider and circuit board and connector terminals are assembled into a lower housing shell and upon joining of the upper and lower shells the wobble stick engages the slider for sliding in rotary movement and the switch assembly is completed.

DETAILED DESCRIPTION

Figure 1:
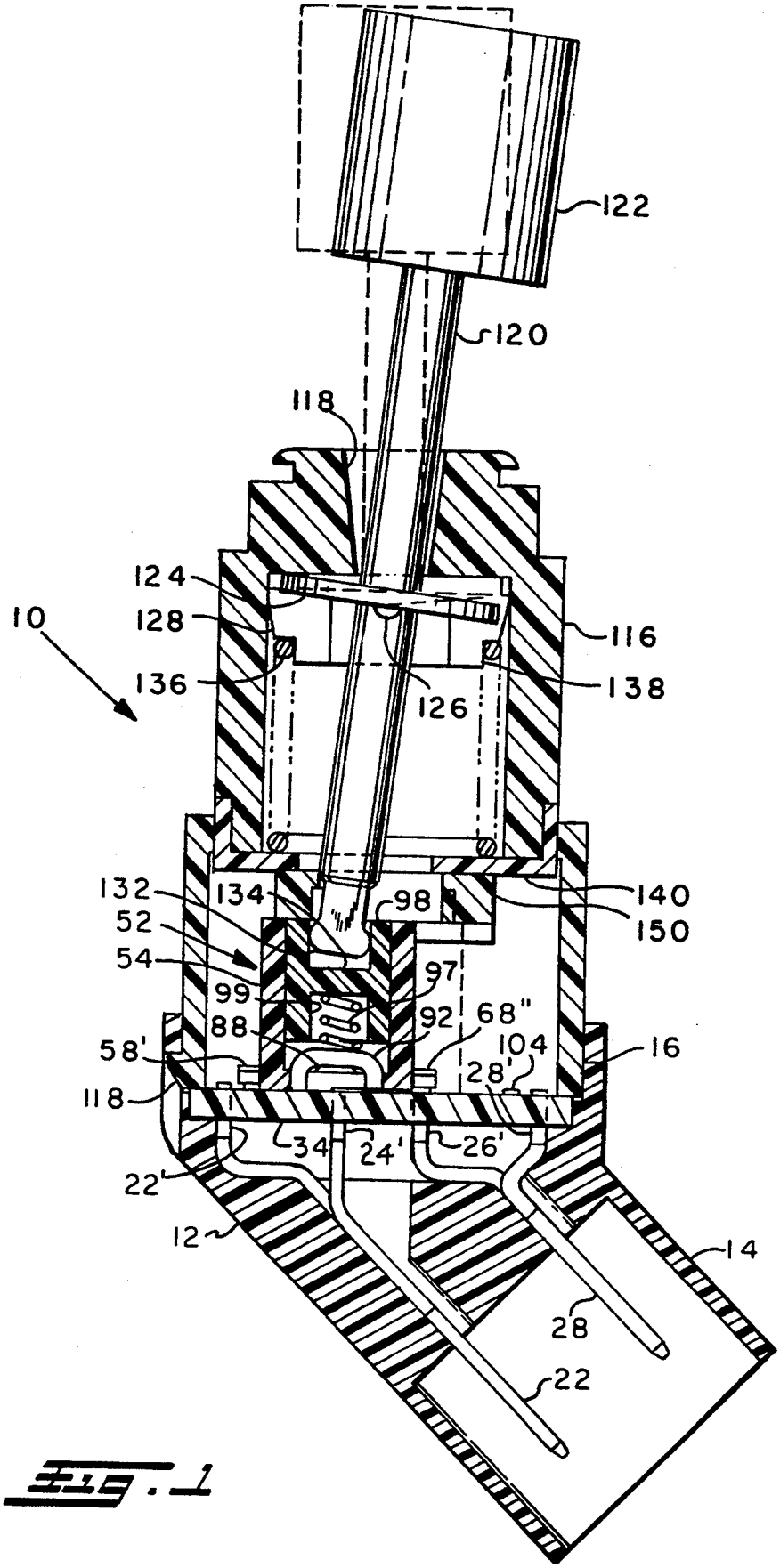
FIG. 1 is a cross-section of the assembled switch of the present invention.
Figure 2:
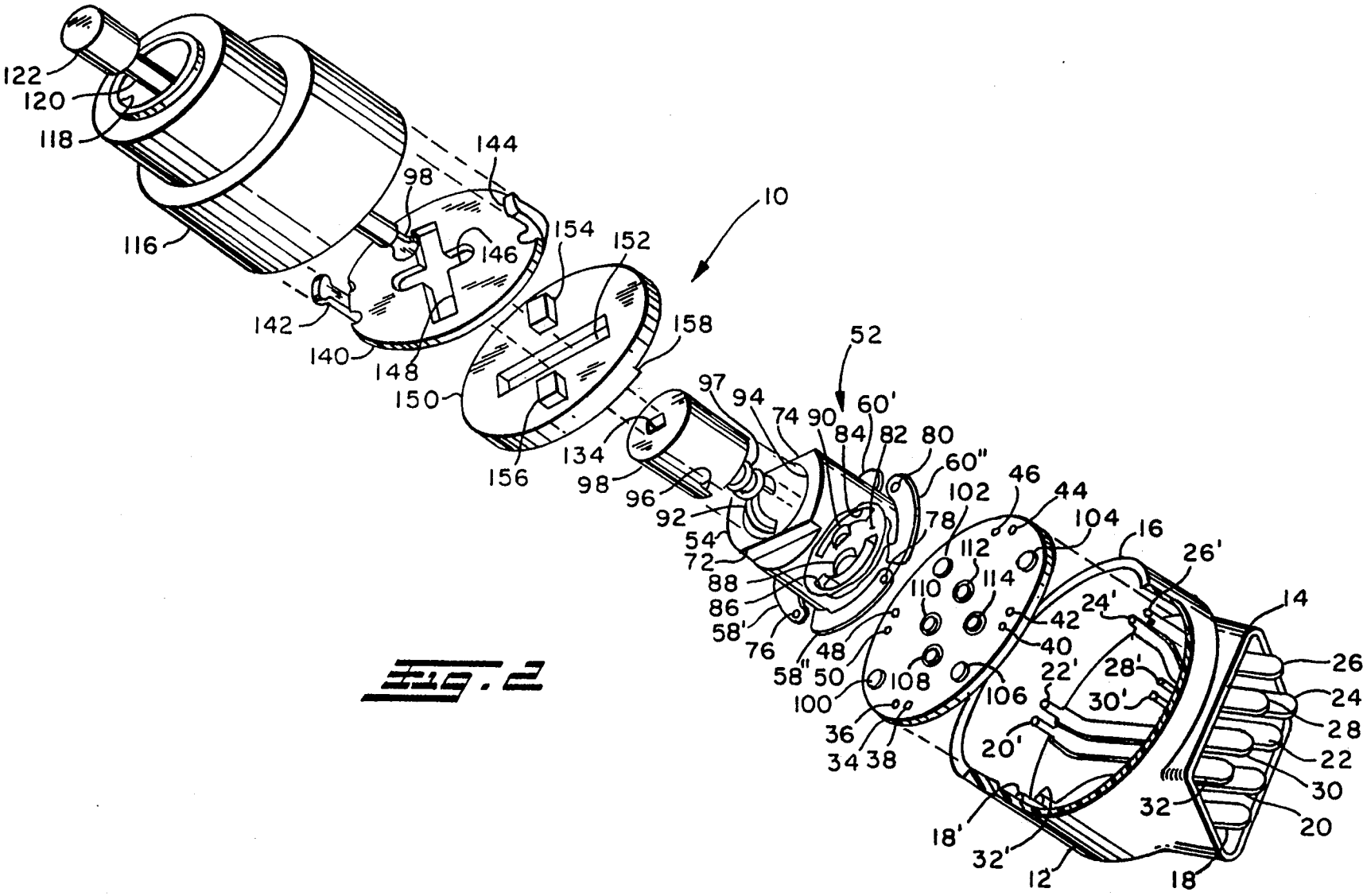
FIG. 2 is an exploded axonometric of the switch of FIG. 1.
Figure 3:
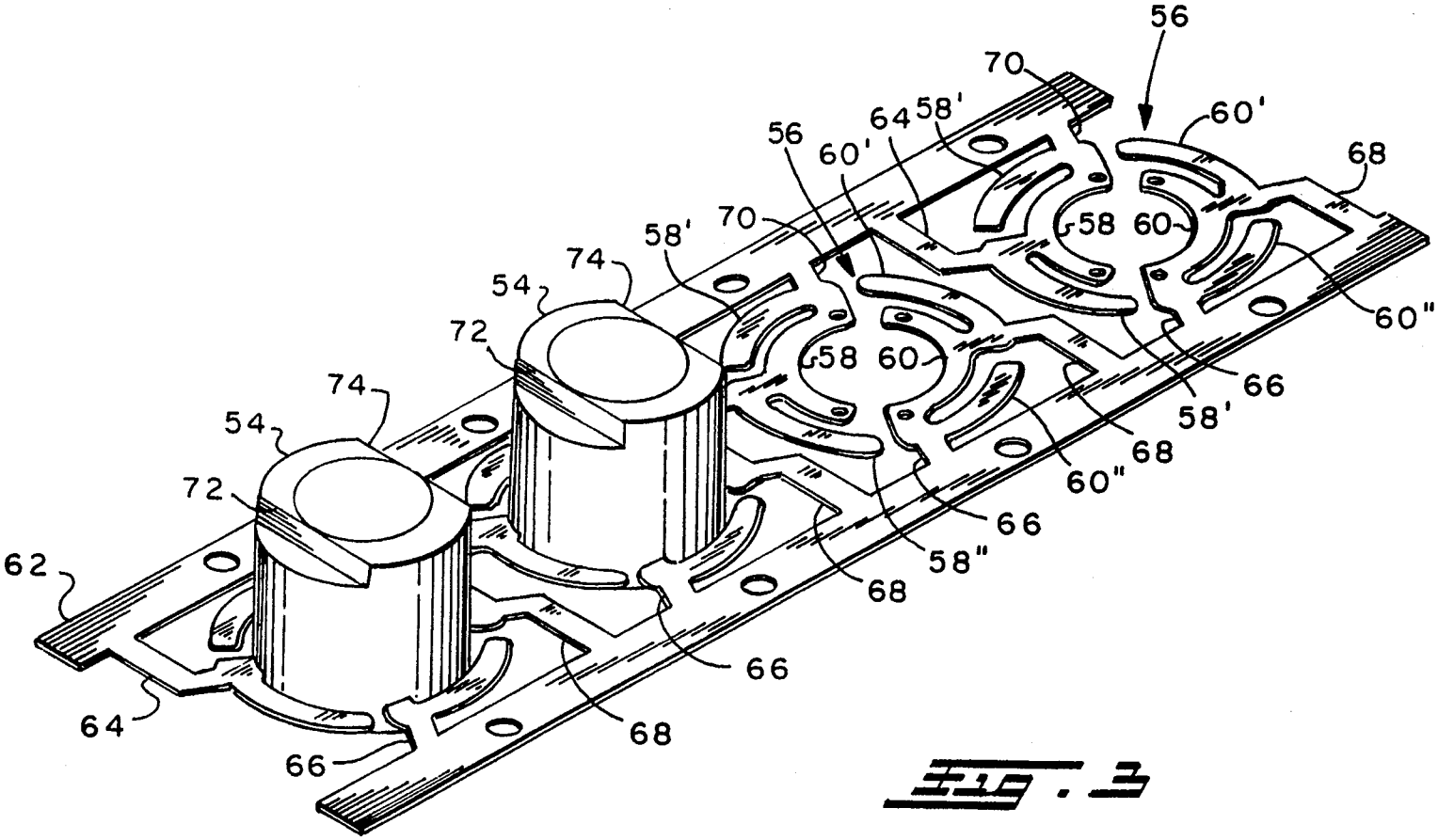
FIG. 3 is an isometric view of the slider as insert molded with the wiper contacts; and, FIG. 4 is an exploded axonometric view of the upper shell and wobble stick subassembly of the switch of FIG. 1.

Referring to FIGS. 1 through 3, the switch assembly is indicated generally at 10, and has a lower housing portion or shell 12 which has an electrical receptacle 14 formed on the lower end thereof and an open cup-shaped cylindrical upper section 16. The lower housing shell receptacle 14 has disposed therein a plurality of pairs of contact terminals disposed in two spaced rows and denoted by reference numerals 18 through 32 in FIG. 2. The terminals 18 through 32 extend inwardly to the cup-shaped section 16 of the lower housing shell and have the ends thereof disposed in spaced pairs in quadrature adjacent the inner surface of the wall of the portion 16, as denoted by reference numerals 18' through 32', and which ends are configured as round pins.

A circuit board, preferably having the connectors thereof (not shown) printed and etched on the undersurface of the board, is indicated by reference numeral 34. A plurality of apertures are provided therein corresponding to the location of the pins 18' through 32' which apertures are denoted by reference numerals 36 through 50 in FIG. 2. Each of the apertures 36–50 has one of the pins 18' through 32' received therein and electrically connected to a conductive strip (not shown) on the undersurface of board 34 and secured thereon as, for example, by soldering.

A slider subassembly indicated generally at 52 has an annular tubular contact holder 54 which is molded with a metal insert denoted generally by reference numeral 56 in FIG. 3. The metal insert 56 includes a pair of oppositely spaced arcuate segments 58,60 which are connected each to a pair of arcuately configured circumferentially spaced wipers denoted by reference numerals 58',58'', and 60',60'' which are formed by stamping in a metal strip 62 and separated therefrom individually after molding by shearing of the remaining web pieces denoted by reference numerals 64,66,68,70 in FIG. 3. The holder 54 has a pair of parallel flats formed on opposite sides of the upper end thereof as denoted by reference numerals 72,74, which serve as guide surfaces for sliding movement as will hereinafter be described. Each of the wiper arms 58',58'',60',60'' has a wiper contact provided on the end thereof, as denoted by reference numerals 76,78,80 for three of the wiper arms as shown in FIG. 2.

Referring to FIG. 2, the holder 54 has a portion broken away to show the floor or radially inner web 82, which has a pair of oppositely disposed arcuately shaped slots 84,86 formed through the web 82, in the presently preferred practice, with the slots having an arcuate extension of at least 90 degrees included central angle. A pair of lugs are molded integrally with the web 82 and extend upwardly therefrom as denoted by reference numerals 88,90 in FIG. 2. The lugs 88,90 are disposed in spaced relationship and oriented on a line connecting the mid-points of the arcuate segments 84,86.

A shorting bar 92 having an inverted U-shape has the opposite ends thereof received in one of the arcuate slots 84,86 for rotational movement therein about the axis of the bore 94 of holder 54. The shorting bar 92 is engaged and guided for movement in the arcuate slots 84,86 by being received in slot 96 formed in the bottom of barrel member 98, which is rotatably received in bore 94 in the holder 54. Slot 96 extends diametrically across the bottom of the barrel member 98, and is of sufficient depth in an axial direction to permit the shorting bar 92 to move in an axial direction in the slot. The barrel member 98 has a spring 97 provided in a bore 99 (see FIG. 1) formed in the bottom thereof with the upper end of spring 97 registered thereagainst and the lower end biasing shorting bar 92 downwardly into slots 84,88. The barrel 98, shorting bar 92, and holder 54 comprise the slider subassembly 52 which is registered in sliding engagement on the upper surface of circuit board 34, as will hereinafter be described in greater detail.

Circuit board 34 has four motor control contacts disposed in a first array in quadrature adjacent the outer periphery of the board, as denoted by reference numerals 100,102,104,106, and are connected in the circuit board on the underside thereof (not shown), respectively, to appropriate ones of the terminal pins 18' through 32' for providing the desired operation of the remote servomotors to be controlled (not shown) when individual adjacent ones of the contacts are connected to complete a circuit.

In operation, as the slider subassembly 52 is moved in opposite directions along mutually orthogonal axes parallel to the circuit board 34, the wiper contacts short between the selected adjacent two of the contacts on the circuit board as follows: wiper contacts 78,76 which are electrically in common through arcuate strip 58 connect contacts 100,106. Movement of the subassembly 52 in the opposite direction causes wiper contact 80 and the contact (not visible in FIG. 2) at the end of wiper 60' interconnect contacts 102 and 104. Movement of the subassembly 52 in a direction perpendicular to the aforesaid movement causes wiper contacts 78 and 80 to interconnect contacts 106,104; and, movement in the opposite direction causes contact 76 to contact stationary contact 100 and the unshown contact on wiper arm 60' to contact stationary contact 102.

The circuit board 34 has provided in the central region thereof a second contact array comprising two pairs of contacts disposed equally spaced in quadrature, with one of the contacts positioned so as to be located under one end of the arcuate slots 84,86; and, the contacts are denoted by reference numerals 108,110,112,114 in FIG. 2. When the barrel 98 and shorting bar 92 are rotated in a clockwise direction from the position shown in solid outline in FIG. 2 by an amount of 45 degrees, shorting bar 92 drops from lugs 88,90 and the ends of the shorting bar 92 make contact with stationary contacts 108,112, which serves to select the desired remote servomotor to be operated. It will be understood that the contacts are connected on the circuit board to appropriate ones of the connector terminals.

When the barrel 98 and shorting bar 92 are rotated in a counter-clockwise direction from the positions shown in solid outline in FIG. 2, the ends of the shorting bar 92 drop off the lugs 88,90 and make contact with stationary contacts 110,114 on the circuit board for selecting another remote servomotor to be operated via the unshown connections on the bottom of circuit board 34 to the appropriate connector terminals. When the barrel 98 and shorting bar 92 are rotated to the center or neutral position shown in solid outline in FIG. 2, the shorting bar is raised upwardly by the lugs 88,90 and the ends of the shorting bar are prevented from contacting any of the contacts on the circuit board 34. With reference to FIG. 1, the shorting bar 92 is shown in the operating position is lowered from lugs 88,90 with the ends thereof contacting the contacts on the circuit board.

Figure 4:
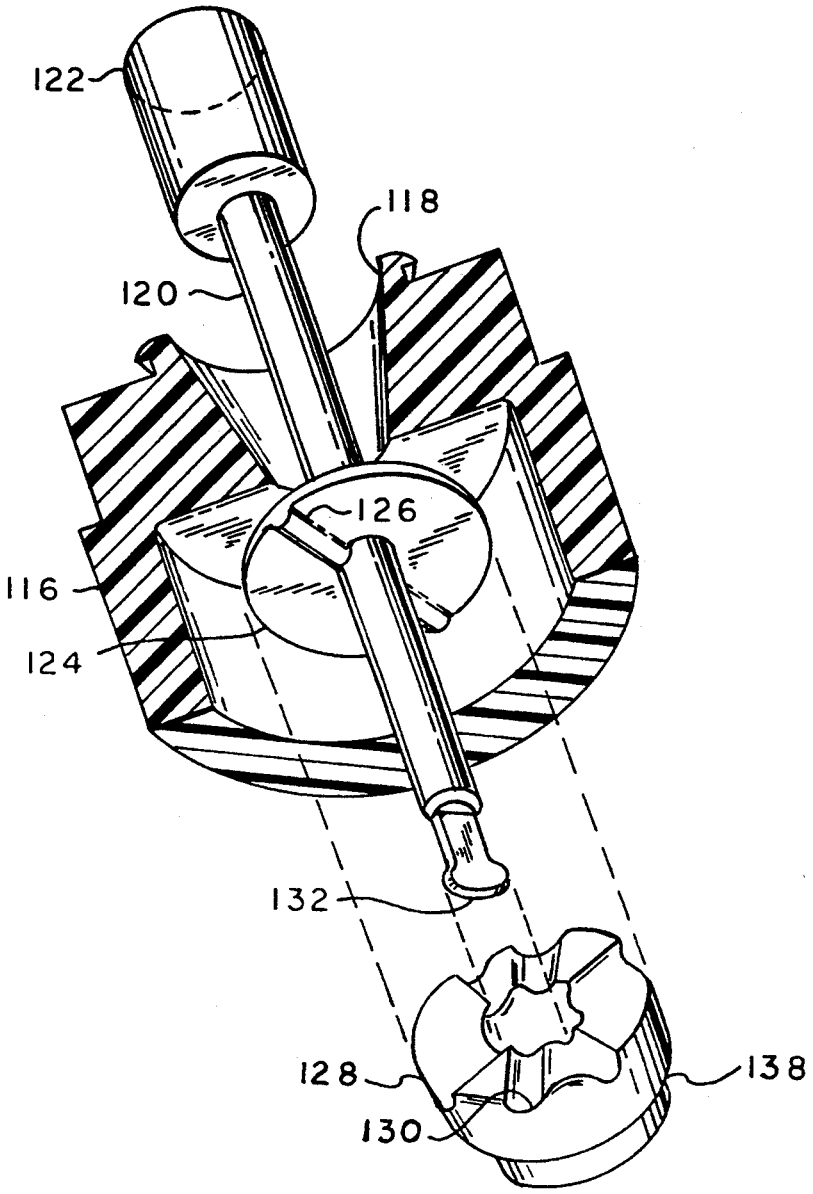

Referring to FIGS. 1, 2, and 4, an upper housing shell 116 is provided and has a generally inverted cup-shaped configuration with the lower rim thereof adapted to be received in the upper portion 16 of the lower housing shell 12 and secured therein by any suitable expedient as, for example, snap-locking tabs denoted by reference numeral 118 in FIG. 1. Housing shell 116 has an aperture 118 formed therein with a wobble stick received therethrough indicated at 120, which has a knob on the end thereof extending outwardly the housing 118 and denoted by reference numeral 122. Wobble stick 120 has a radially outwardly-extending flange 124 formed thereon and positioned interiorly of the housing 116. Flange 124 has a semi-cylindrical rib 126 formed on the underside thereof and extending diametrically thereacross. Stick 120 extends axially beyond flange 124 for engagement with the slider assembly 152, as will hereinafter be described.

A collar 128 is received over the lower portion of the stick 120; and, collar 128 has detent surfaces 130 provided on the upper surface thereof for providing a tactile feel for the rotary central position of the stick 120 when the stick is rotated about its own axis. The lower end of stick 120 has provided thereon a lug 132, which has a rectangular shape in transverse cross-section, and which lug engages a recess 134 having a rectangular transverse section, and which is formed in the upper surface of the barrel 98.

In operation, rotation of stick 120 about its own axis by the user results in rotation of the barrel 98 within holder 54 which provides for rotary movement of the shorting bar 92.

Referring to FIGS. 1 and 2, bias spring 136 has the upper end thereof registered against the groove 138 formed about the lower end of collar 128; and, the lower end of the spring 136 is registered against the upper surface of a retaining disk 140 which is received in upper housing shell 116 and retained therein by locking tabs 142,144. The spring 136 is thus compressed, and urges the collar upward to provide a detent force for the rib 126 in the surfaces 130 of the collar.

Disk 140 has slots 146,148 formed therethrough, which are intersecting and mutually at right angles to permit lateral movement of stick 120 along the direction of two perpendicular axes.

A second disk-shaped member 150 has a pair of spaced rectangular lugs 154,156 disposed on the upper surface thereof in diametrically opposed relationship and aligned with and extending into slot 148 in the disk 140. The line connecting lugs 154,156 is at right angles to the direction of an elongated slot 152 formed in the disc 150 between lugs 154,156. Disc 150 is in juxtaposed arrangement with the undersurface of disc 140. The lugs 154,156 thus ensure that slot 148 is in disc 140 which is oriented at right angles to the direction of elongation of slot 152 in disc 150.

In operation, movement of wobble stick 12 engages the side of slot 152 and causes lugs 154,156 on member 150 to slide in slot 148. Movement of the wobble stick 120 in the slot 146 is freely permitted inasmuch as slot 146 is aligned directly above slot 152. Disc 150 has a groove 158 formed in the lower surface thereof and aligned with slot 152 and groove 158 engages flat surfaces 72,74 on the upper surface of slider 54. Upon movement of the wobble stick in slot 146, barrel 98 and slider 54 are permitted to move by virtue of sliding engagement of the flat surfaces 72,74 in groove 158.

User movement of the wobble stick 120 at right angles to slot 152, or in the direction of slot 148, causes lugs 154,156 to slide in slot 148, permitting disk 150 to move in a direction transverse to slot 152; and, relative movement between the slider 154 and disk 150 is prevented by engagement of groove 158 with the flat surfaces 72,74 and the holder 54 is moved by disc 150. It will be understood that in cooperation with the lugs 156,154 and the groove 158, the holder 54 is limited to movement along two orthogonal axes by stick 120 insofar as rectilinear movement is concerned. The barrel 98 may be rotated within the member 54 by rotation of stick 122 about its own axis, causing lug 132 to rotate barrel 98 within the holder 54. It will be understood that a low deflection rate spring will be employed to bias the shorting bar 92 in the direction of the detent lugs 90,88, but that for clarity of illustration, such a spring has been omitted from the drawings.

The present invention thus provides an easy-to-manufacture and assemble wobble stick type control switch assembly which is operable upon lateral movement for remotely controlling bi-directional movement of servomotors. Rotary movement of the wobble stick provides for an additional switching function to select, as between locations of remote motors. The present invention employs a slider which moves wiper contacts over a circuit board wherein the slider is formed by insert molding of plastic over a metal strip having the wipers formed therein and punching the molded wiper subassembly from the strip.

Although the invention has hereinabove been described with respect to the illustrated embodiments, it will be understood that the invention is capable of modification and variation, and is limited only by the following claims.

I claim:

1. A Servomotor remote control switch comprising:

(a) housing means including circuit board means having a plurality of pairs of spaced contacts disposed thereon and a plurality of connector terminals connected to said board means and adapted for external electrical connection thereto;

(b) slider means including first and second shorting bar means operable upon movement along one of two orthogonal axes to cause said first shorting bar means to complete a circuit between a first pair of contacts and upon movement along the other of said orthogonal axes to complete a circuit between a second pair of contacts, said slider means operable upon rotation about an axis normal to said orthogonal axes to cause said second shorting bar to complete a circuit between a third pair of contacts; and (c) wobble stick means mounted for pivotal movement on said housing means with one end extending exteriorly of said housing with the opposite end thereof engaging said slider means, said stick means operable upon user movement to effect said movement of said slider means in said orthogonal directions, said stick means operable upon user rotation about its longitudinal direction to effect said rotation of said slider means about said normal axis, wherein said second shorting bar is lifted from said circuit board in a neutral position intermediate a clockwise and a counterclockwise position.

2. The switch defined in claim 1, wherein said housing means includes an upper shell assembly having said stick means pivotally mounted thereon and a lower shell assembly having said circuit board and said terminals mounted thereon with said stick means engaging said slider means upon joining of said upper and lower shell assemblies.

3. The switch defined in claim 1, wherein said slider means includes said first shorting bar means including a first set of wipers operable to short said first pair of contacts upon movement of said slider means in one direction along one of said orthogonal axes and operable to short a fourth pair of contacts upon movement of said slider means in the direction opposite said one direction along said one of said orthogonal axes; and, said first shorting bar means includes a second set of wipers operable to short said second pair of contacts upon movement of said slider means in one direction along the other of said orthogonal axes and operable to short a fifth pair of contacts upon movement of said slider means along said other of said orthogonal axes in the direction opposite said one direction.

4. The switch defined in claim 1, wherein said second shorting bar means is operable upon clockwise rotation to short said third pair of contacts and upon rotation in a counter-clockwise direction operable to short a sixth pair of contacts.

5. The switch defined in claim 1, wherein said wobble stick means is detented in a neutral position of said rotation.

* * * * *